US008899906B2

(12) United States Patent
Peschel et al.

(10) Patent No.: US 8,899,906 B2
(45) Date of Patent: Dec. 2, 2014

(54) LOCKING MEMBERS FOR PALLET FORK

(75) Inventors: Daniel Eugene Peschel, Manhattan, KS (US); Andrew Lee Vering, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 502 days.

(21) Appl. No.: 13/192,827

(22) Filed: Jul. 28, 2011

(65) Prior Publication Data

US 2013/0028696 A1 Jan. 31, 2013

(51) Int. Cl.
*B66F 9/14* (2006.01)

(52) U.S. Cl.
CPC *B66F 9/142* (2013.01); *B66F 9/144* (2013.01)
USPC ..... 414/667; 414/664; 414/785

(58) Field of Classification Search
CPC ..... B66F 9/12; B66F 9/14; B66F 9/0655; B66F 9/075; B66F 11/04; B66F 9/06; B66F 9/20; B66F 1/00; B66F 7/28; B66F 9/142; E02F 3/286; E02F 3/00; F16B 1/00; B23P 11/00; B60P 1/00; B60P 1/02; B60P 1/16; B62B 3/06; B66C 23/00; B66C 1/00; F15B 3/00; A01D 87/12
USPC ..... 414/722, 592, 603, 607, 619, 667, 685, 414/705, 723, 785, 815, 912, 920, 927–929, 414/24.5, 274, 275, 460, 471, 474, 476, 414/482, 483, 485, 495, 544, 546, 547, 608, 414/620–666, 668–672, 674, 680, 684, 686, 414/687, 694, 703, 718, 728, 814, 911; 172/272–275; 187/222, 237; 701/50
See application file for complete search history.

(56) References Cited

U.S. PATENT DOCUMENTS

| | | | | | |
|---|---|---|---|---|---|
| 4,355,944 | A * | 10/1982 | Lorenc | 414/685 |
| 4,850,789 | A | 7/1989 | Zimmerman | |
| 4,963,071 | A | 10/1990 | Larwin | |
| 4,986,751 | A * | 1/1991 | Bergersen | 433/6 |
| 5,061,149 | A * | 10/1991 | Lowder et al. | 414/687 |
| 5,314,292 | A | 5/1994 | Holopainen | |
| 5,639,205 | A | 6/1997 | Kaczmarczyk | |
| 6,056,503 | A * | 5/2000 | Way et al. | 414/722 |
| 6,132,164 | A * | 10/2000 | Way et al. | 414/685 |
| 6,168,369 | B1 | 1/2001 | Bright | |
| 6,971,696 | B1 * | 12/2005 | Koester et al. | 294/120 |
| 6,990,838 | B2 | 1/2006 | Witchey | |
| 2008/0232944 | A1 * | 9/2008 | Kim | 414/667 |
| 2010/0101895 | A1 * | 4/2010 | Collins et al. | 187/237 |

FOREIGN PATENT DOCUMENTS

| | | |
|---|---|---|
| EP | 1586708 | 7/2008 |

* cited by examiner

*Primary Examiner* — Saul Rodriguez
*Assistant Examiner* — Ronald Jarrett
(74) *Attorney, Agent, or Firm* — Baker Hostetler

(57) ABSTRACT

A pallet fork including a frame and a fork tine. The frame supports a fork bar and a carriage plate. Further, the fork bar and the carriage plate extend in a longitudinal direction of the pallet fork. The fork tine is mounted to the fork bar. Also, the fork tine has a swingable motion and a lateral motion relative to the fork bar. Moreover, the fork tine includes a vertical leg and a horizontal leg. A bracket is attached to the vertical leg of the fork tine. A first locking member is selectively inserted in the bracket to engage the fork tine with the carriage plate and restrict the swingable motion of the fork tine.

19 Claims, 5 Drawing Sheets

LOCKING MEMBERS FOR PALLET FORK

TECHNICAL FIELD

The disclosure relates to implements for lifting loads, and more specifically a pallet fork for a wheel loader or other machinery.

BACKGROUND

United States Patent Application Publication Number 2010/0101895 relates to a pallet fork including a structural frame, a fork bar, a swing bar, and a pair of fork tines. The swing bar may be selectively inserted through a pair of locks, provided in the fork tines, to fix and restrict a swingable motion of the fork tines. Further, the swing bar can be conveniently stored onboard the pallet fork when it is inoperative.

SUMMARY OF THE DISCLOSURE

In one aspect, the present disclosure provides a pallet fork including a frame and a fork tine. The frame supports a fork bar and a carriage plate. The fork bar and the carriage plate extend in a longitudinal direction. The fork tine is mounted to the fork bar. The fork tine has a swingable motion and a lateral motion relative to the fork bar. The fork tine includes a vertical leg and a horizontal leg. A bracket is attached to the vertical leg of the fork tine. A first locking member is selectively inserted in the bracket to engage the fork tine with the carriage plate and restrict the swingable motion of the fork tine.

In another aspect, the disclosure provides a method for locking a fork tine to a frame of a pallet fork. The method mounts the fork tine to a fork bar supported on the frame. The method then aligns a vertical leg of the fork tine with a carriage plate supported on the frame. Subsequently, the method inserts a first locking member in a bracket provided on the vertical leg, in order to engage the fork tine with the carriage plate and restrict a swingable motion of the fork tine.

Other features and aspects of this disclosure will be apparent from the following description and the accompanying drawings.

DETAILED DESCRIPTION

Figure 1:
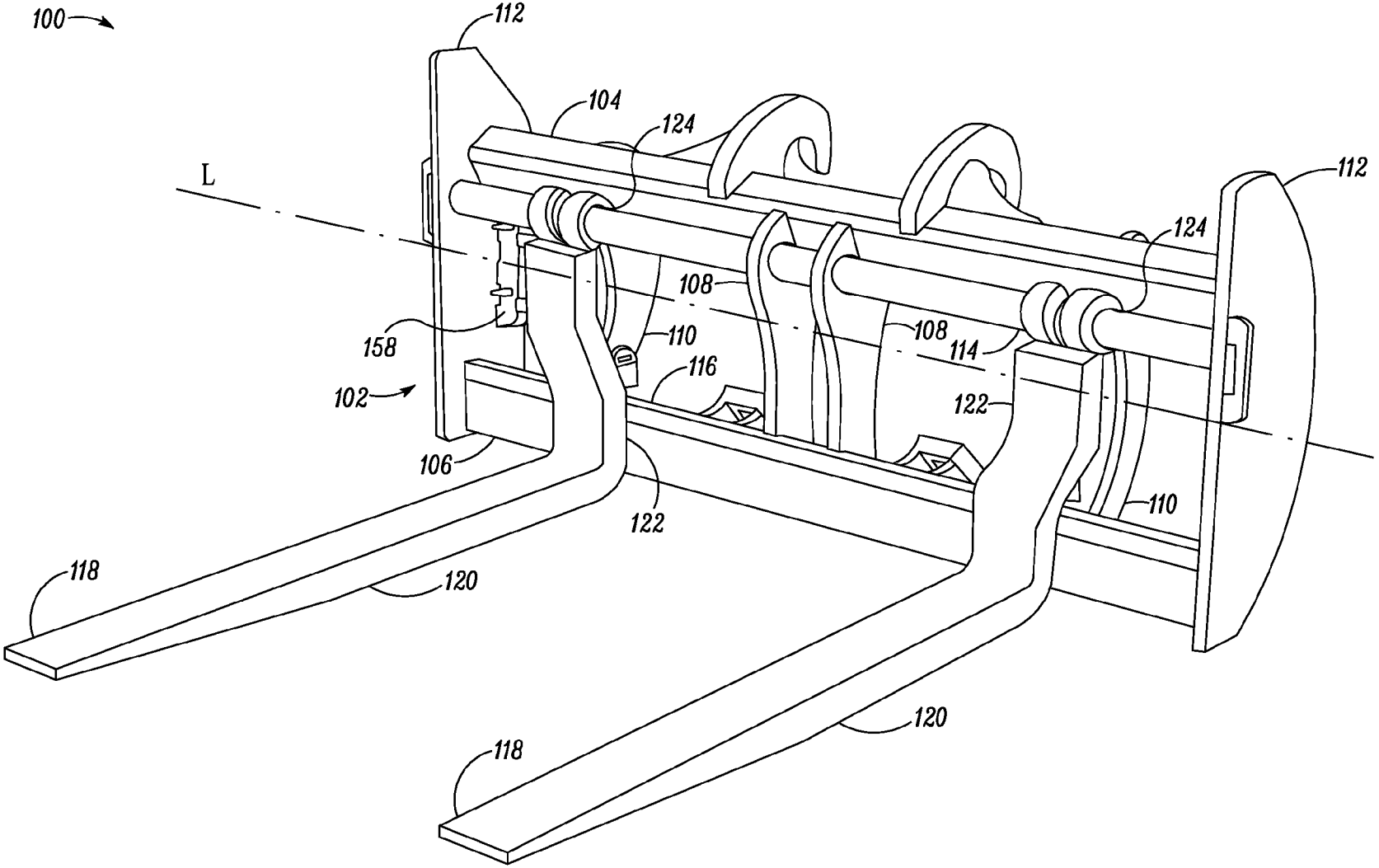
FIG. 1 is a perspective view of a pallet fork, according to an embodiment of the present disclosure.

FIGS. 1-5 illustrate various views of a pallet fork 100, according to an embodiment of the present disclosure. The pallet fork 100 includes a frame 102. The frame 102 may take many different forms as will be recognized by those of ordinary skill in this art. In the illustrated embodiment the frame 102 may include a top support tube 104 and a bottom support tube 106. The top support tube 104 and the bottom support tube 106 may form individual structural members of the pallet fork 100 and may be disposed approximately parallel to one another.

The top support tube 104 and bottom support tube 106 are secured together by sets of ribs, such as a set of inner ribs 108 and a set of outer ribs 110. The inner ribs 108 are the vertically oriented plates near a center point or a midplane of the top support tube 104 and the bottom support tube 106. The inner ribs 108 are structurally joined to the top support tube 104 and the bottom support tube 106 by welding, brazing, or any other practical means. The inner ribs 108 may be approximately parallel to one another, and approximately normal to the top support tube 104 and the bottom support tube 106. The inner ribs 108 are two separate plate-like members in the illustrated embodiment, however may be formed as a single plate or other element, or more than two plates, based on the design of the pallet fork 100.

Likewise, the outer ribs 110 are the vertically oriented plates close to the distal ends of the top support tube 104 and the bottom support tube 106. The outer ribs 110 are also structurally joined to the top support tube 104 and the bottom support tube 106 by welding, brazing, or any other practical means. The outer ribs 110 may be approximately parallel to one another. The outer ribs 110 may also be approximately normal to the top support tube 104 and the bottom support tube 106. The outer ribs 110 are two separate plate-like members in the illustrated embodiment, however may be formed as more than two individual plates or other elements, based on the design of the pallet fork 100.

The distal ends of the top support tube 104 and the bottom support tube 106 are joined by a pair of end plates 112. The end plates 112 may be structurally joined to the top support tube 104 and the bottom support tube 106 by welding, brazing, riveting, or any other practical means. The end plates 112 may be vertically oriented plate-like members, and may be approximately parallel to one another and approximately normal to the top support tube 104 and the bottom support tube 106.

Moreover, as illustrated in FIGS. 1-5, the frame 102 may support a fork bar 114 and a carriage plate 116. The fork bar 114 and the carriage plate 116 may extend in a longitudinal direction L of the pallet fork 100 and supported by the end plates 112, the inner ribs 108, and the outer ribs 110. The end plates 112 and the inner ribs 108 may include substantially parallel and aligned bores for supporting the fork bar 114. Further, the fork bar 114 may be bolted to the end plates 112 to keep the fork bar 114 from retracting out of the bores.

In an embodiment, the pallet fork 100 may include a single fork bar 114 spanning between the end plates 112, or alternatively the fork bar 114 may be divided into two separate bars which may be joined at the center of the pallet fork 100. Dividing the fork bar 114 into two separate smaller bars facilitates assembling and disassembling as each bar will be shorter and also weigh less. In an embodiment, the carriage plate 116 may be structurally joined to the bottom support tube 106 by welding, brazing, bolts, screws, rivets, or any other practical means. In another embodiment, the carriage plate 116 may be formed integrally with the bottom support tube 106. However, in yet another embodiment, the carriage plate 116 may be provided anywhere between the top support tube 104 and the bottom support tube 106, and supported by the end plates 112, the inner ribs 108, and the outer ribs 110.

A pair of fork tines 118 are mounted to the fork bar 114. Each of the fork tines 118 may include a horizontal leg 120 and a vertical leg 122 which are approximately normal to one another. As illustrated in FIG. 1, a bore 124 may be provided on the vertical leg 122 of each of the fork tines 118 which is configured to receive the fork bar 114. Each of the fork tines 118 may have a swingable motion about the fork bar 114 at the bore 124. Further, each of fork tines 118 may also have a lateral motion along the fork bar 114 in the longitudinal direction L.

Figure 2:
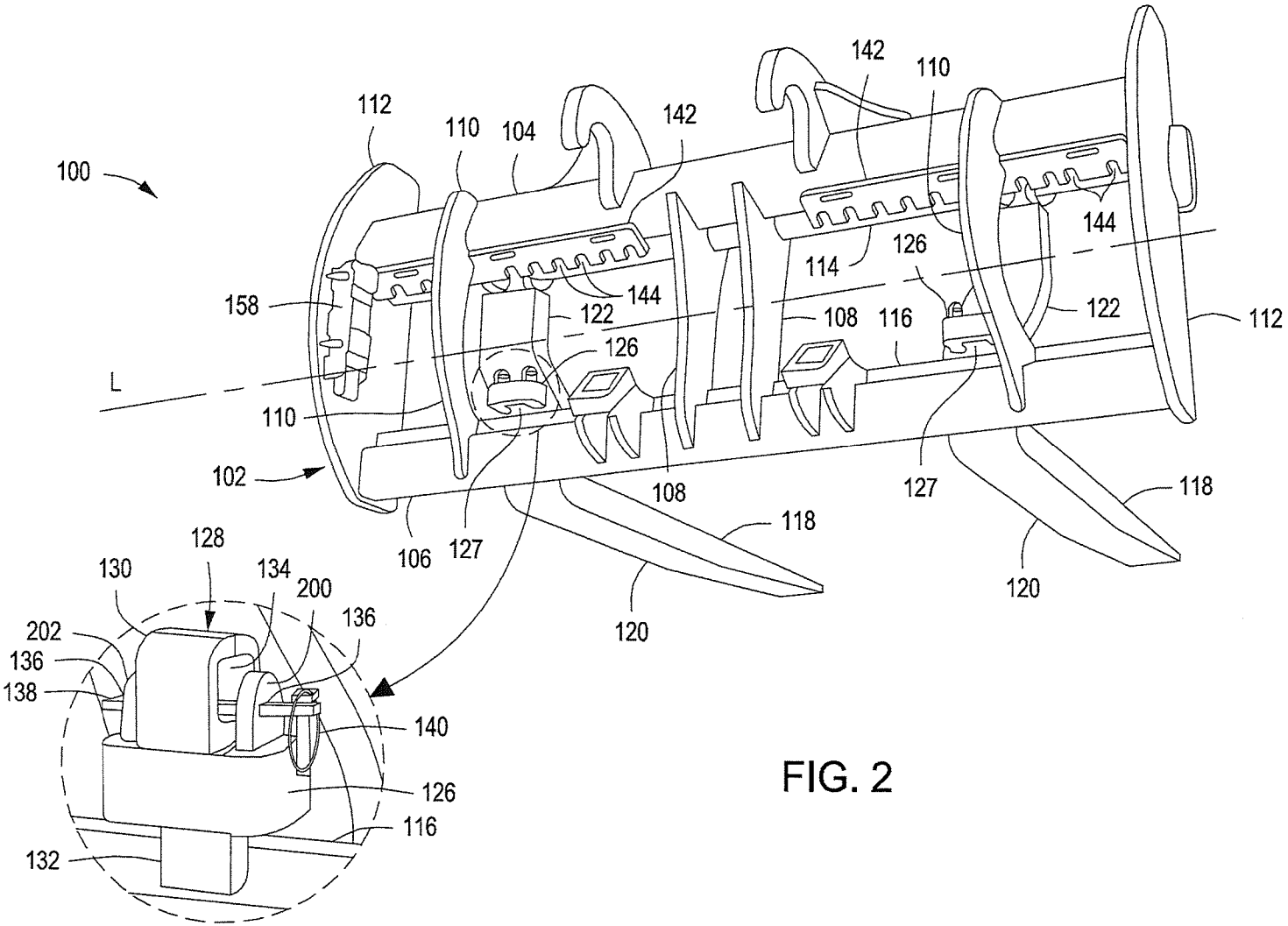
FIG. 2 is another perspective view of the pallet fork of FIG. 1, and a first locking member.

FIGS. 2-5 illustrate various other views of the pallet fork 100. As illustrated in FIG. 2, a bracket 126 may be attached to the vertical leg 122 of each of the fork tines 118. The bracket 126 may be disposed in the proximity of the carriage plate 116 and joined to the vertical leg 122 of the fork tine 118 by welding, brazing, riveting or any other practical means. Further, the bracket 126 may have an opening 127, substantially normal to the longitudinal direction L, such that a first locking member 128 may be selectively inserted in the opening 127 of the bracket 126.

In an embodiment, the first locking member 128 may include a head portion 130 and a shaft portion 132. The shaft portion 132 of the first locking member 128 is configured to be partially received in the opening 127 of the bracket 126 and partially adjoined to the carriage plate 116. Further, the head portion 130 of the first locking member 128 may have a through-hole 134, which is substantially aligned to a pair of apertures 136 provided on the bracket 126.

In an embodiment, a first pin 138 is configured to be selectively inserted in the through-hole 134 of the first locking member 128, and the apertures 136 are defined by the first and second attaching structure 200 and 202 mounted on the bracket 126, to hold the first locking member 128 in the bracket 126. The first pin 138 may be a pull lock pin with a ring grip 140. In various other embodiments, the first locking member 128 may have different shape, for example, but not limited to, a looped shape, a folded/clamp shape, or any other practical shape. Moreover, the first locking member 128 may use a bolt and nut assembly to hold the first locking member 128 in the bracket 126.

Figure 3:
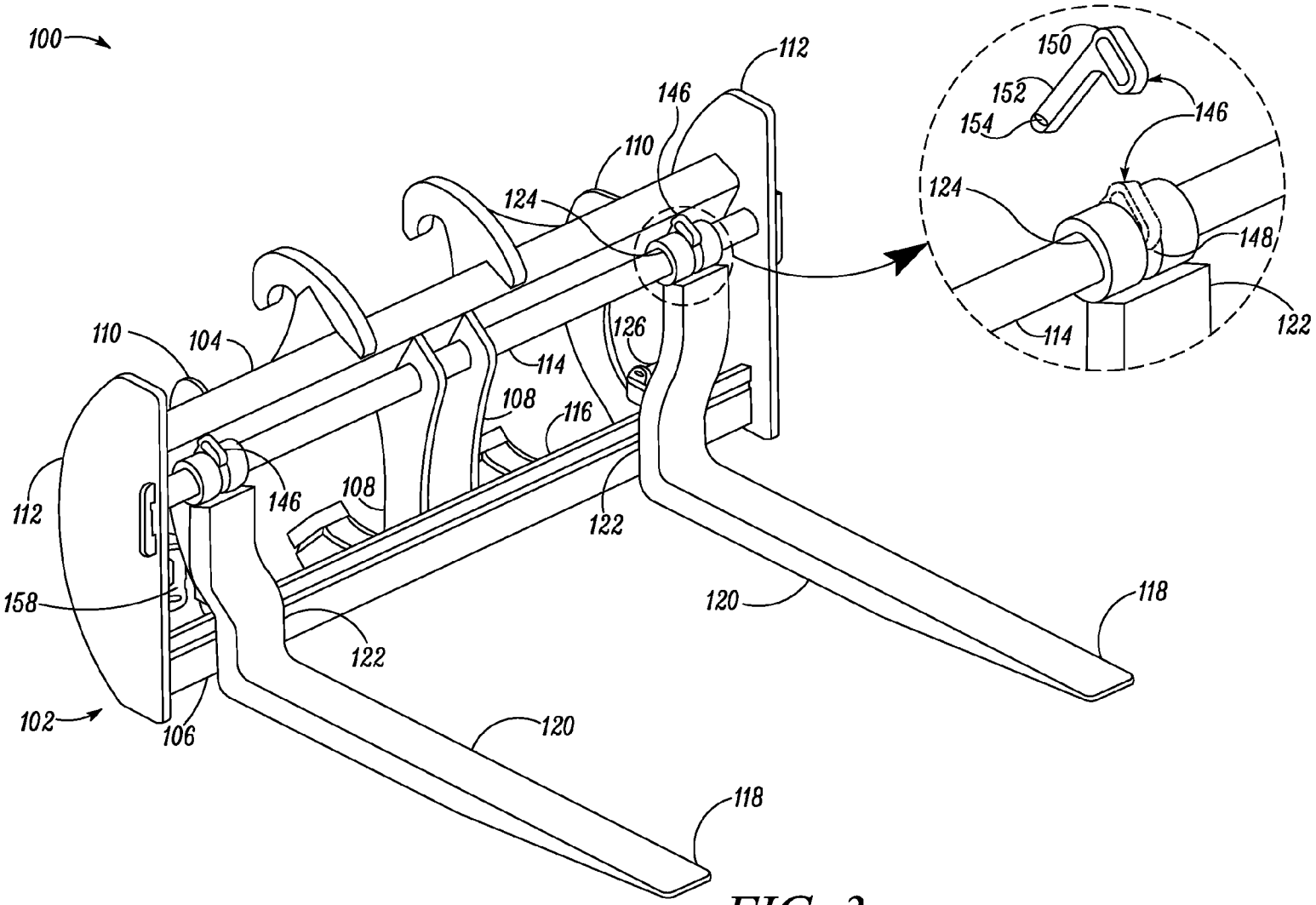
FIG. 3 is another perspective view of the pallet fork of FIG. 1, and a second locking member.
Figure 4:
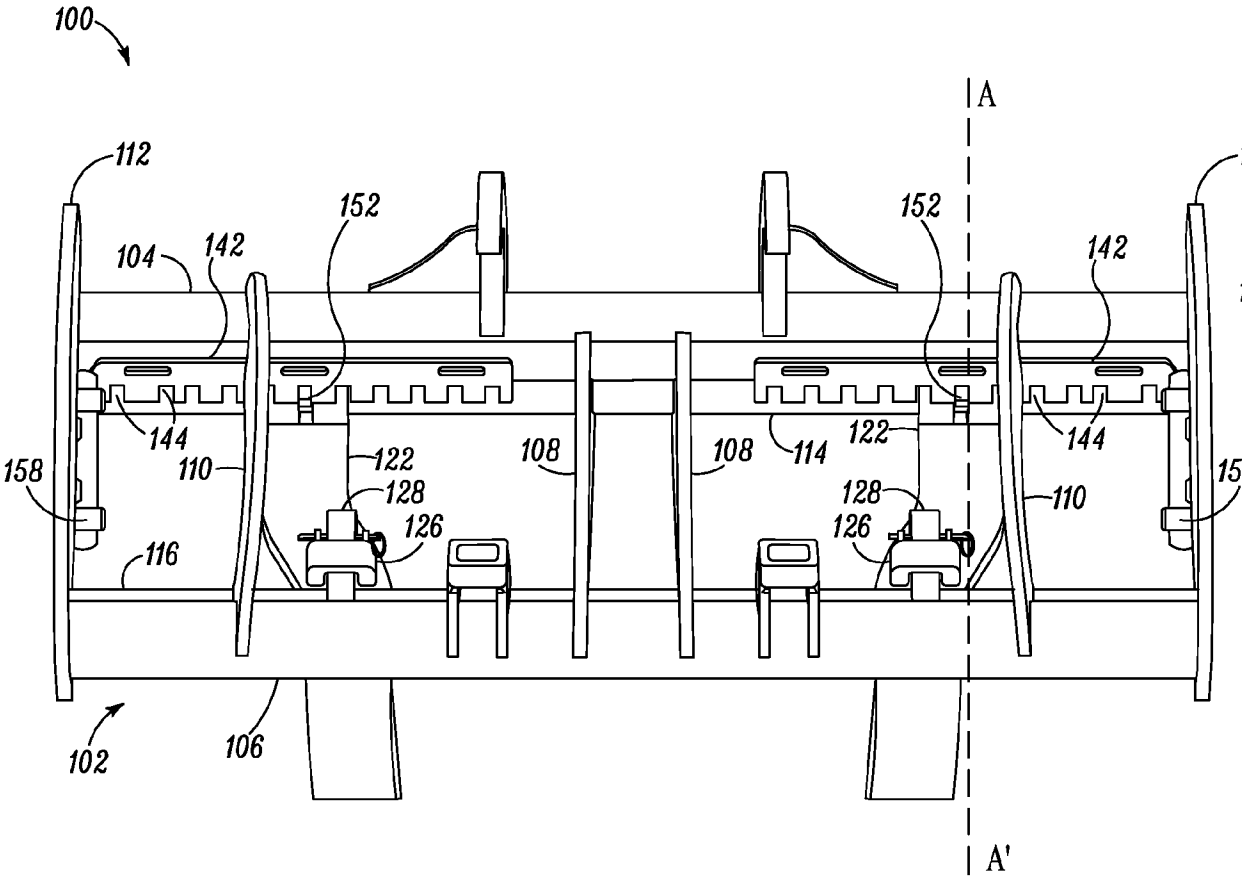
FIG. 4 is a rear view of the pallet fork of FIG. 1, and the first locking member and the second locking member.

In one embodiment, a locking plate 142 may be provided on the top support tube 104 of the frame 102. The locking plate 142 may have one or more notches 144. As illustrated in FIG. 3, a second locking member 146 is configured to be selectively inserted through a slot 148 provided on the vertical leg 122 of the fork tine 118. In an embodiment, the second locking member 146 may include a head portion 150 and a shaft portion 152. Further, the shaft portion 152 may include an aperture 154. As illustrated in FIG. 4, the shaft portion 152 of the second locking member 146 may be selectively inserted into the notch 144 of the locking plate 142 through the slot 148.

Figure 5:
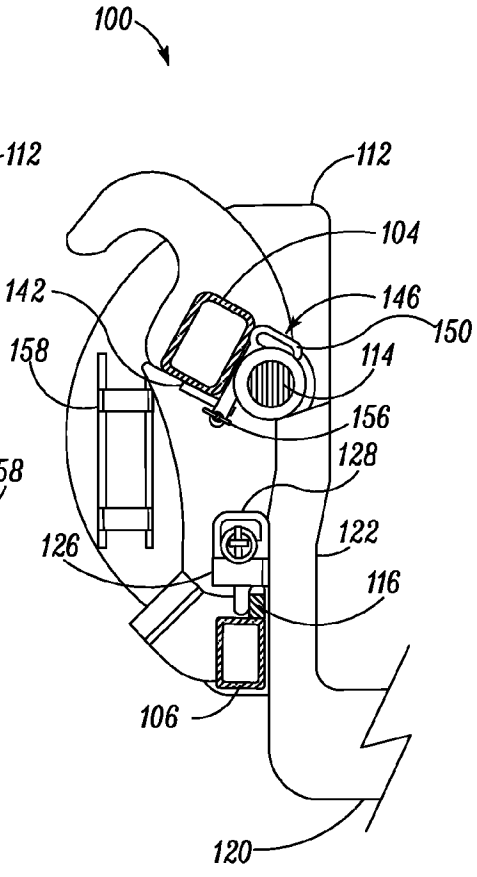
FIG. 5 is a sectional view of the pallet fork of FIG. 4 about an axis AA'.

FIG. 5 illustrates a sectional view of the pallet fork 100 of FIG. 4 about an axis AA'. As illustrated in FIG. 5, the head portion 150 of the second locking member 146 may be configured to rest on the fork bar 114. Further, a second pin 156 may be selectively inserted in the aperture 154 (see FIG. 3) of the second locking member 146. The second pin 156 may be a pull lock pin selectively inserted in the aperture 154 to hold the second locking member 146 in the notch 144 of the locking plate 142.

As illustrated in FIGS. 1-5, the pallet fork 100 may include a retainer 158 to store the first locking member 128 and/or the second locking member 146, when not in use. The retainer 158 may be mounted on the pair of end plates 112 by welding, brazing, riveting, or any other practical means.

Industrial Applicability

The pallet fork 100 may be used in a wheel loader, a track loader or any other machinery. The fork tines 118 can be fixed, or be allowed to swing about the fork bar 114 when the pallet fork 100 tilts forward. In addition, the fork tines 118 can be laterally moved along the fork bar for customizing according to palletized loads. In an aspect, the first and the second locking members 128 and 146 may be selectively used to restrict the swingable and the lateral motion of the fork tines 118, respectively.

Figure 6:
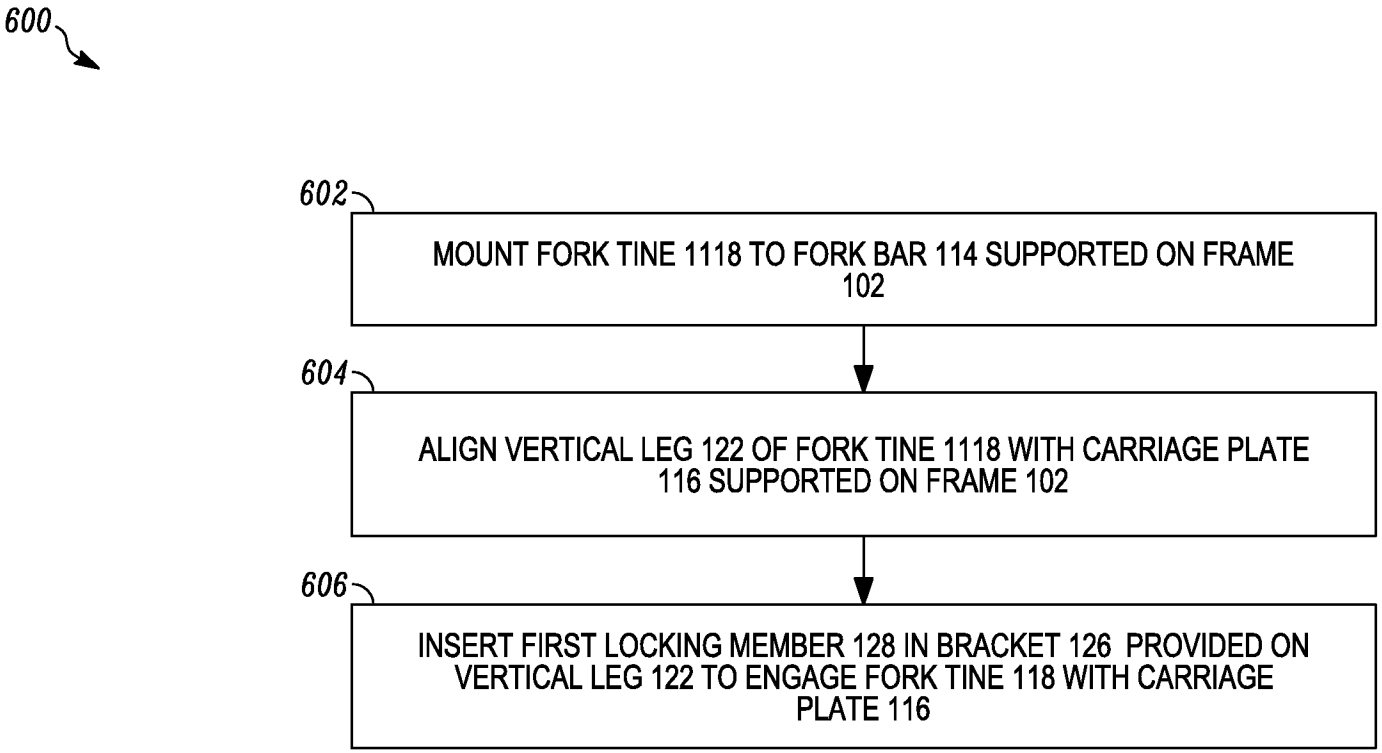
FIG. 6 is a block diagram of a locking sequence used to lock the fork tine to a frame of the pallet fork.

As shown in FIG. 6, a block diagram of a locking sequence 600 used to lock the fork tine 118 to the frame 102 of the pallet fork 100 is provided. As described herein, the disclosure provides a quick and retrofittable technique of restricting the swingable motion of the fork tine 118 relative to the frame 102 of the pallet fork 100. At step 602, the fork tine 118 may be mounted to the fork bar 114. As described earlier, the bore 124 provided on the vertical leg 122 of the fork tine 118 may receive the fork bar 114.

Subsequently, at step 604, the vertical leg 122 of the fork tine 118 may be aligned with the carriage plate 116, which is connected to the bottom support tube 106 of the frame 102 of the pallet fork 100. The alignment may be achieved by moving the fork tine 118 to bring the vertical leg 122 of the fork tine 118 in contact with the bottom support tube 106 of the frame 102.

Finally, at step 606, the first locking member 128 may be selectively inserted in the bracket 126 provided on the vertical leg 122 of the fork tine 118, to engage the fork tine 118 with the carriage plate 116 of the frame 102. The swingable motion of the fork tine 118 relative to the fork bar 114 supported on the frame 102 may be restricted by first locking member 128.

The first locking member 128 described above is a locking device including the head portion 130 and the shaft portion 132. Moreover, the first locking member 128 may be fixed or removed from the bracket 126 without any tools. Additionally, the first locking member 128 may not hamper visibility of an operator through the frame 102 to the ends of the fork tines 118 and also to the load to be picked-up. In an embodiment, as illustrated in FIG. 5, the top support tube 104 may be angled with respect to the bottom support tube 106 to further improve the visibility of the operator.

In yet another embodiment, the second locking member 146 may be inserted in the notch 144 of the locking plate 142 supported on the frame 102, as described above. The second locking member 146 may assist in restricting the lateral motion of the fork tine 118 relative to the fork bar 114. Moreover, the second locking member 146 may be held in the notch 144 by selectively inserting the second pin 156 in the second locking member 146. Additionally, the first locking member 128 and/or the second locking member 146 may be stored in the retainer 158 when not in use.

In an aspect of the illustrated embodiment, the carriage plate 116, the bracket 126, and the locking plate 142 are retrofittable to an existing pallet fork by a cost effective method including welding, brazing or riveting, or any other practical means.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A pallet fork comprising:

a frame supporting a fork bar and a carriage plate, the fork bar and the carriage plate extending in a longitudinal direction of the pallet fork;

a fork tine mounted to the fork bar, the fork tine having a swingable motion and a lateral motion relative thereto, the fork tine including a vertical leg and a horizontal leg;

a bracket attached to the vertical leg of the fork tine the bracket defining an attaching structure; and a first locking member defining a first hole, the first locking member configured to be selectively inserted in the bracket to engage the fork tine with the carriage plate and restrict the swingable motion of the fork tine, and the attaching structure defines a second hole and the first hole and the second hole are aligned with each other when the first locking member is in the bracket.

2. The pallet fork of claim 1, further including a first pin configured to be selectively inserted in the first hole of the first locking member to hold the first locking member in the attaching structure of the bracket.

3. The pallet fork of claim 1, wherein the frame further includes a top support tube, a bottom support tube, and a pair of end plates joining the top support tube and the bottom support tube, the carriage plate attached to the bottom support tube.

4. The pallet fork of claim 3 including a locking plate having a notch provided on the top support tube of the frame.

5. The pallet fork of claim 4 further including:

a bore provided on the vertical leg of the fork tine, the bore configured to receive the fork bar; and a second locking member configured to be selectively inserted in the notch of the locking plate to engage the vertical leg of the fork tine with the locking plate and restrict the lateral motion of the fork tine.

6. The pallet fork of claim 5 further including a second pin configured to be selectively inserted in the second locking member to hold the second locking member in the notch.

7. The pallet fork of claim 5 further including a retainer mounted on the pair of end plates to store the first locking member and the second locking member.

8. The pallet fork of claim 1, further comprising a second locking structure that defines a third hole that is substantially parallel with the first hole in the first locking member.

9. A pallet fork comprising:

a frame having a top support tube, a bottom support tube and a pair of end plates configured to join the top support tube and the bottom support tube;

a fork bar extending in a longitudinal direction of the pallet fork and supported between the pair of end plates;

a locking plate having a notch attached to the top support tube;

a carriage plate extending in the longitudinal direction and attached to the bottom support tube;

a fork tine mounted to the fork bar, the fork tine having a swingable motion and a lateral motion relative thereto, the fork tine including a vertical leg and a horizontal leg;

a bore provided on the vertical leg, the bore configured to receive the fork bar;

a bracket attached to the vertical leg of the fork tine the bracket defining first attaching structure;

a first locking member defining a first hole, the first locking member configured to be selectively inserted in the bracket to engage the fork tine with the carriage plate and restrict the swingable motion of the fork tine, and the attaching structure defines a second hole and the first hole and the second hole are aligned with each other when the first locking member is in the bracket; and a second locking member configured to be selectively inserted in the notch of the locking plate to engage the vertical leg of the fork tine with the locking plate and restrict the lateral motion of the fork tine.

10. The pallet fork of claim 9 further including a first pin configured to be selectively inserted in the first hole of the first locking member to hold the first locking member in the attaching structure of the bracket.

11. The pallet fork of claim 9 further including a second pin configured to be selectively inserted in the second locking member to hold the second locking member in the notch.

12. The pallet fork of claim 9 further including a retainer mounted on the pair of end plates to store the first locking member and the second locking member.

13. A method of locking a fork tine to a frame of a pallet fork, the method comprising:

mounting the fork tine to a fork bar supported on the frame;

aligning a vertical leg of the fork tine with a carriage plate supported on the frame; and inserting a first locking member having a first hole in a bracket provided on the vertical leg to engage the fork tine with the carriage plate and restrict a swingable motion of the fork tine; and aligning a second hole defined by an attaching structure on the bracket with the first hole on the first locking member.

14. The method of claim 13 further including holding the first locking member in the bracket by selectively inserting a first pin in the first hole on the first locking member and the attaching structure on the bracket.

15. The method of claim 13 further including inserting a second locking member in a notch provided on a locking plate supported on the frame and restrict a lateral motion of the fork tine.

16. The method of claim 15 further including holding the second locking member in the notch by selectively inserting a second pin in the second locking member.

17. The method of claim 15 further including storing the first locking member and the second locking member in a retainer mounted on the frame.

18. The pallet fork of claim 9, further comprising a second locking structure that defines a third hole that is substantially parallel with the first hole in the first locking member.

19. The method of claim 13, further comprising aligning a hole in a second attaching structure with the first hole.

* * * * *

UNITED STATES PATENT AND TRADEMARK OFFICE

CERTIFICATE OF CORRECTION

PATENT NO. : 8,899,906 B2
APPLICATION NO. : 13/192827
DATED : December 2, 2014
INVENTOR(S) : Peschel et al.

It is certified that error appears in the above-identified patent and that said Letters Patent is hereby corrected as shown below:

In the Specification:

Column 3, line 62, delete "Industrial Applicability" and insert -- INDUSTRIAL APPLICABILITY --.

Signed and Sealed this
Seventeenth Day of November, 2015

Michelle K. Lee

Michelle K. Lee
*Director of the United States Patent and Trademark Office*